US008687769B2

(12) United States Patent
Behling

(10) Patent No.: US 8,687,769 B2
(45) Date of Patent: Apr. 1, 2014

(54) X-RAY ANODE

(75) Inventor: Rolf Karl Otto Behling, Norderstedt (DE)

(73) Assignee: Koninklijke Philips N.V., Eindhoven (NL)

( * ) Notice: Subject to any disclaimer, the term of this patent is extended or adjusted under 35 U.S.C. 154(b) by 279 days.

(21) Appl. No.: 13/130,863

(22) PCT Filed: Nov. 19, 2009

(86) PCT No.: PCT/IB2009/055173

§ 371 (c)(1),
(2), (4) Date: May 24, 2011

(87) PCT Pub. No.: WO2010/061324

PCT Pub. Date: Jun. 3, 2010

(65) Prior Publication Data

US 2011/0222664 A1 Sep. 15, 2011

(30) Foreign Application Priority Data

Nov. 25, 2008 (EP) ..... 08169888

(51) Int. Cl.
*H01J 35/06* (2006.01)

(52) U.S. Cl.
USPC ..... 378/134; 378/124

(58) Field of Classification Search
USPC ..... 378/113, 124, 125, 134, 144
See application file for complete search history.

(56) References Cited

U.S. PATENT DOCUMENTS

| | | | | |
|---|---|---|---|---|
| 5,907,592 | A | 5/1999 | Levinson | |
| 6,560,315 | B1 | 5/2003 | Price et al. | |
| 7,120,222 | B2 * | 10/2006 | Hoffman | 378/5 |

FOREIGN PATENT DOCUMENTS

| | | | |
|---|---|---|---|
| DE | 1020060370860 | A1 | 8/2006 |
| DE | 102007019176 | A1 | 4/2007 |
| FR | 2819141 | A1 | 7/2002 |
| WO | 2007129248 | A1 | 11/2007 |
| WO | 2008056299 | A1 | 5/2008 |
| WO | 2009083848 | A1 | 7/2009 |

* cited by examiner

*Primary Examiner* — Jurie Yun

(57) ABSTRACT

A rotatable anode for an X-ray tube comprises a first unit (901) for being hit by a first electron beam, and at least a second unit (902) being hit by at least a second electron beam, the second unit being electrically isolated from the first. In addition, an X-ray system comprises the anode, a main cathode for generating an electron beam, and first electrical potential, and an auxiliary cathode for influencing a second electrical potential. The main cathode deflects the electron beam to heat the auxiliary cathode. Furthermore, a device determines electrical potential by detecting a point of impact of the electron beam onto the anode and/or by detecting an X-ray spectrum of radiation starting from the anode. The electron beam hits the first unit and is deflected, wherein the deflected beam hits the second unit the point of impact. The first unit and/or second unit emit radiation.

14 Claims, 12 Drawing Sheets

X-RAY ANODE

FIELD OF THE INVENTION

The present invention relates to a rotatable anode for an X-ray tube device and a main cathode, wherein the main cathode is adapted to interact with an anode. Further, the present invention relates to an auxiliary cathode, wherein the auxiliary cathode is adapted to interact with an anode, an X-ray system, a device for determining an electrical potential, a device for adjusting the heating of an auxiliary cathode, a device for switching electrical potentials and a device for deflecting the electron beam of an X-ray system.

BACKGROUND OF THE INVENTION

Using multiple X-ray photon energies ("X-ray colors") enhance the diagnostic value of an X-ray image. Usually, a regular X-ray tube is used and the high voltage is being altered.

SUMMARY OF THE INVENTION

Ideally, the pulse time of high and low energy periods should be in the range of an integration period of the detector, e.g. 200 μs in case of a CT-scanner. The transition time needs to be a small fraction of this, to achieve a sufficiently high duty cycle and photon flux. But the capacity of the high voltage cable makes discharging a slow process in practice. Short pulsing can hardly be achieved with reasonable effort. Furthermore, an X-ray filter should be switched in sync.

The anode according to the invention comprises bulk anode material, which has a radialy slotted isolating body, made of e.g SiC ceramics. SiC has high electrical resistivity at T<1000 C, is light weight and has high yield strength. Therefore, SiC is suitable as anode material. An alternative is e.g. SiN. The focal track of each segment is coated with e.g. Wolfram or Rhenanium to generate X-rays upon impact of electrons from a primary electron beam and carries its own high voltage potential. Slits and bulk material are arranged for isolation. Some segments generate the high energy photons and are connected to the plus electrode of the high voltage generator, through the anode bearing. Others are connected with each other, too ("printed circuit"). Their potential floats and is closer to the cathode potential. The potential is given by self-charging in the primary electron beam and a controllable conductor to the plus electrode, e.g. using a thermo ionic emitter, which is heated by the electron beam, which is temporarily deflected towards it during segment transition.

According to a first aspect of the invention it is provided a rotatable anode for an X-ray tube, wherein the anode comprises a first unit adapted for being hit by a first electron beam at least a second unit adapted for being hit by at least a second electron beam, wherein the first unit and the at least second unit are electrically isolated from each other.

According to the invention the anode is separated electrically into different parts, which have different electrical potential in order to generate X-ray radiations with different energies. Due to the inventive arrangement it is possible to provide X-ray radiations with different energies without switching the anode between different electrical potentials. This possibility leads to the effect that there is a very quick change of different X-ray radiations. Therefore, it is possible to generate during a definite period of time more images, which enhances the possibilities of diagnosis of the patient under examination.

According to the invention the X-ray generating top layers of the anode segments consist of materials A and B or mixtures of them. The materials have different atomic numbers Z and generate different characteristic X-ray spectra upon impact of charged particles (i.e. electrons).

According to a second aspect of the invention, there is provided a main cathode, wherein the main cathode is adapted to interact with an anode, wherein the main cathode is adapted to generate the first electron beam and the second electron beam, and wherein the main cathode comprises means for deflecting the first electron beam for generating the second electron beam.

The main cathode of the inventive X-ray tube has means for deflecting the electron beam starting from the main cathode. This provides the possibility to direct the beam towards different parts of the anode. Therefore, separated different parts of the anode can be hit in order to emit different X-ray radiations.

According to a third aspect of the invention, there is provided an auxiliary cathode, wherein the auxiliary cathode is adapted to interact with an anode, wherein the auxiliary cathode is adapted to influence the second electrical potential, wherein the auxiliary cathode is adapted for being heated by the second electron beam, wherein the auxiliary cathode is adapted to interact with a main cathode, and wherein the second electron beam is generated by the main cathode by deflection of the first electron beam.

The inventive concept comprises an auxiliary cathode, which is coated on a heat conducting ring, heated by the partly deflected primary beam, which is emitted by the main cathode. (Amount of deflection controls temperature and emission of the auxiliary cathode).

According to a fourth aspect of the invention, there is provided an X-ray system, wherein the system comprises an anode, a main cathode for generating an electron beam, wherein the main cathode is adapted to generate a first electrical potential, an auxiliary cathode for influencing a second electrical potential, and wherein the main cathode is adapted to deflect the electron beam in order to heat the auxiliary cathode.

According to a fifth aspect of the invention, there is provided a device for determining an electrical potential by detecting the point of impact of an electron beam onto an anode and/or by detecting an X-ray spectrum of radiation starting from an anode, wherein the electron beam is generated by a cathode, wherein the electron beam hits the first unit of the anode at the point of impact, wherein the electron beam can be deflected, wherein the deflected electron beam hits the second unit of the anode at the point of impact, and wherein the first unit and/or second unit emit the radiation.

When jumping from one to next segment, the focal spot is temporarily deflected azimuthally (electric field between segments). The amount of deflection is a measure of the electric field and therefore the potential of the low-energy segments. This information can be used for controlling the emission of the auxiliary cathode and by this to control its electrical potential. Another possibility to measure would be the spectrum of the primary X-rays which are emitted from the low-energy segments (ratio of strongly filtered to less-filtered X-ray intensity).

The desired current is the difference between primary electron current, leakage current through the anode insulator and self emission from the hot focal spot track. The emission needs to be adjusted according to a closed loop feed-back of the voltage signal. The voltage signal may be derived from a focal spot deflection during passage from high to low energy segments or from the x-ray spectrum at low energy.

According to a sixth aspect of the invention, there is provided a device for adjusting the heating of an auxiliary cathode, wherein the device is adapted to control the heating of the auxiliary cathode.

According to a seventh aspect of the invention, there is provided a device for switching electrical potentials, wherein the device is adapted to connect or isolate the first electrical potential and the second electrical potential of an X-ray system. For operation in single-energy mode (multi-purpose-tube), the floating segments may be short-circuited to plus electrode by means of a controllable switch (e.g. using a heated bi-metal or a magnetic control).

According to a eighth aspect of the invention, there is provided a device for deflecting the electron beam of an X-ray system, wherein the device is adapted to direct the electron beam to the first unit of an anode.

According to a eighth aspect of the invention it is provided a device for deflecting the electron beam of an X-ray system according to one of the claims 9 to 11, wherein the device is adapted to direct the electron beam to the first unit of an anode according to one of the claims 1 to 6.

Further embodiments are incorporated in the dependent claims.

According to an exemplary embodiment it is provided an anode, wherein the first unit is a first part of a circular ring of the anode, wherein the at least second unit is at least a second part of the circular ring of the anode.

According to another exemplary embodiment it is provided an anode, wherein the first unit is a first circular ring and the at least second unit is at least a second circular ring, wherein the first circular ring and the at least second circular ring are separated by at least a further circular ring, wherein the further circular ring is non-conductive.

According to a further exemplary embodiment it is provided an anode, wherein the anode is adapted in such a way, that the first unit has a first electrical potential and the at least second unit has at least a second electrical potential, wherein the first electrical potential and the at least second electrical potential are different.

According to another exemplary embodiment it is provided an anode, wherein the first unit has a first surface for being hit by the first electron beam, the at least second unit has at least a second surface for being hit by the second electron beam, wherein the first surface is smaller than the at least second surface.

There is much more photon flux from high energy segments $S_h$ than from low energy segments $S_l$. Therefore, the isolating gaps are cut to the expense of the width of the $S_h$'s in order to have the same total amount of energy emerging from the high X-ray energy segments and the low X-ray energy segments.

According to an exemplary embodiment it is provided an anode, wherein the first unit has a first electrical potential, wherein the at least second unit has at least a second electrical potential, wherein the absolute value of the first electrical potential is higher than the absolute value of the at least second electrical potential.

According to a further exemplary embodiment it is provided an X-ray system, wherein the main cathode is adapted to deflect the electron beam during the transition of a gap of the electron beam, wherein the gap is arranged between the first unit and the at least second unit of the anode. During gap transition, the primary electron beam is deflected and heats the auxiliary cathode. The amount of deflection and heating controls the emission current at a given voltage and provides potential control of the low-energy segments $S_l$.

According to another exemplary embodiment it is provided an X-ray system, wherein the first unit is connected to a potential supplied by an external source, wherein the at least second unit is connected to the auxiliary cathode. Another embodiment makes use of additional voltage supplies from outside the tube to the at least second unit and additional insulation. This enables more possibilities to generate X-rays with different radiation spectra.

It should be noted that the above features may also be combined. The combination of the above features may also lead to synergetic effects, even if not explicitly described in detail.

These and other aspects of the present invention will become apparent from and elucidated with reference to the embodiments described hereinafter.

BRIEF DESCRIPTION OF THE DRAWINGS

Exemplary embodiments of the present invention will be described in the following with reference to the following drawings.

DETAILED DESCRIPTION OF EMBODIMENTS

Figure 1:
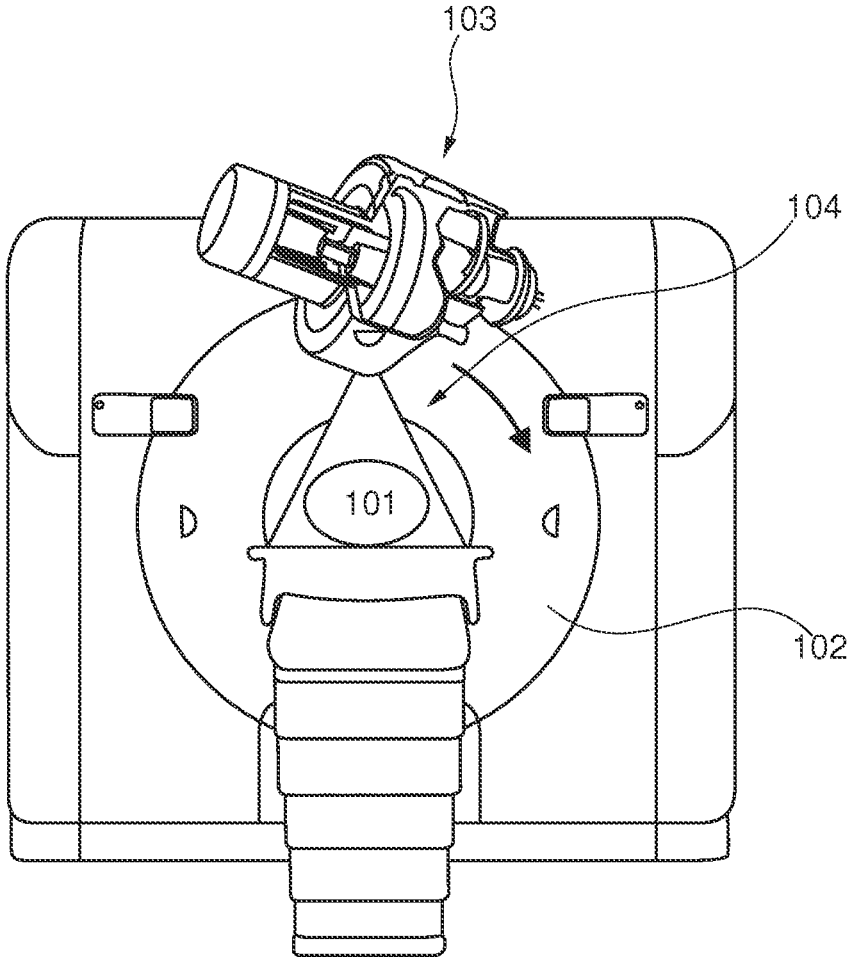
FIG. 1 shows an X-ray system with an X-ray tube.

FIG. 1 depicts an X-ray tube 103 comprising an anode, which is rotating about the patient 101 under examination and generates a fan beam of X-rays 104. Opposite and with it on a gantry rotates a detector system 102, which converts the attenuated X-rays to electrical signals. A computer system reconstructs an image of the patient's inner morphology.

Figure 2:
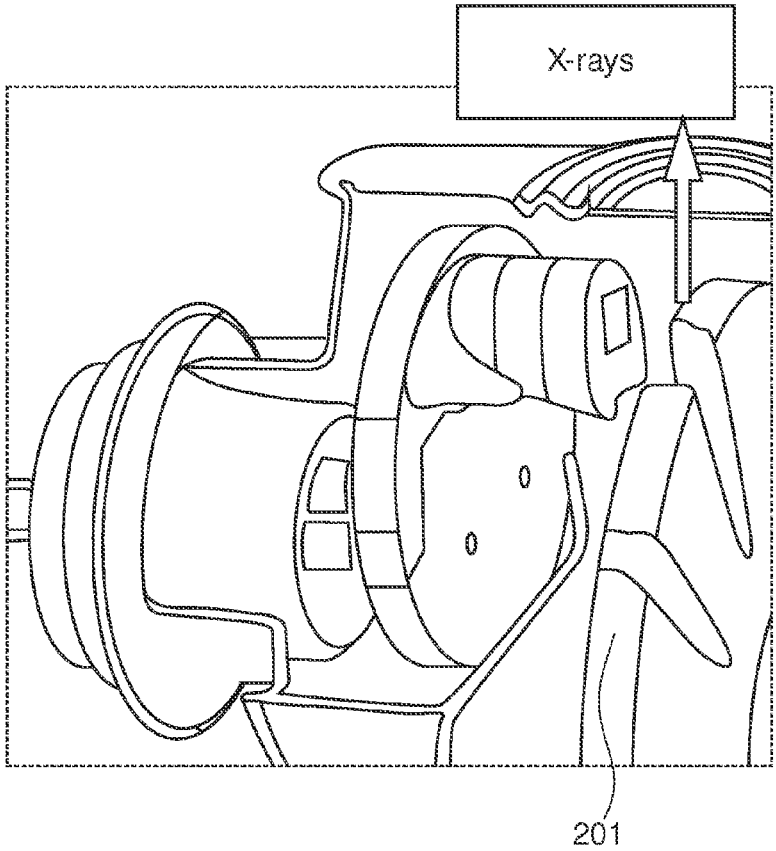
FIG. 2 shows an X-ray tube.

FIG. 2 shows an X-ray tube comprising an anode 201, which will be hit by an electron beam generating X-rays.

Figure 3:
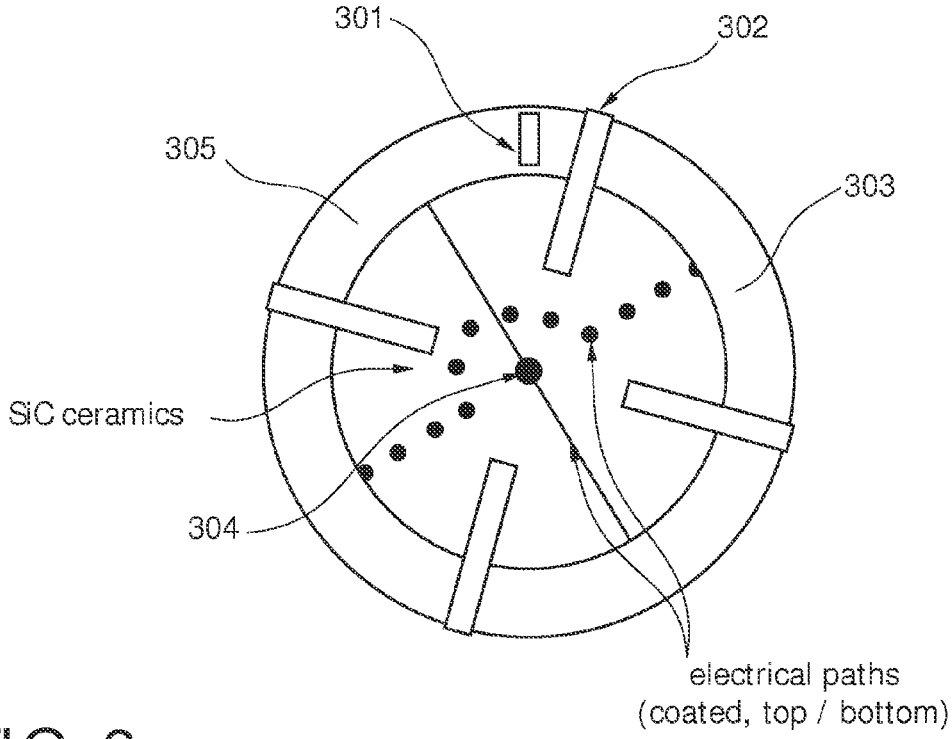
FIG. 3 shows an anode.

FIG. 3 shows an anode for an X-ray tube schematically, wherein the anode comprises focal tracks 303, 305. These focal tracks 303, 305 are separated electrically by isolating slits 302. The anode rotates around its center 304. Further, it is depicted a focal spot 301 shown on e.g. high energy segment.

Figure 4:
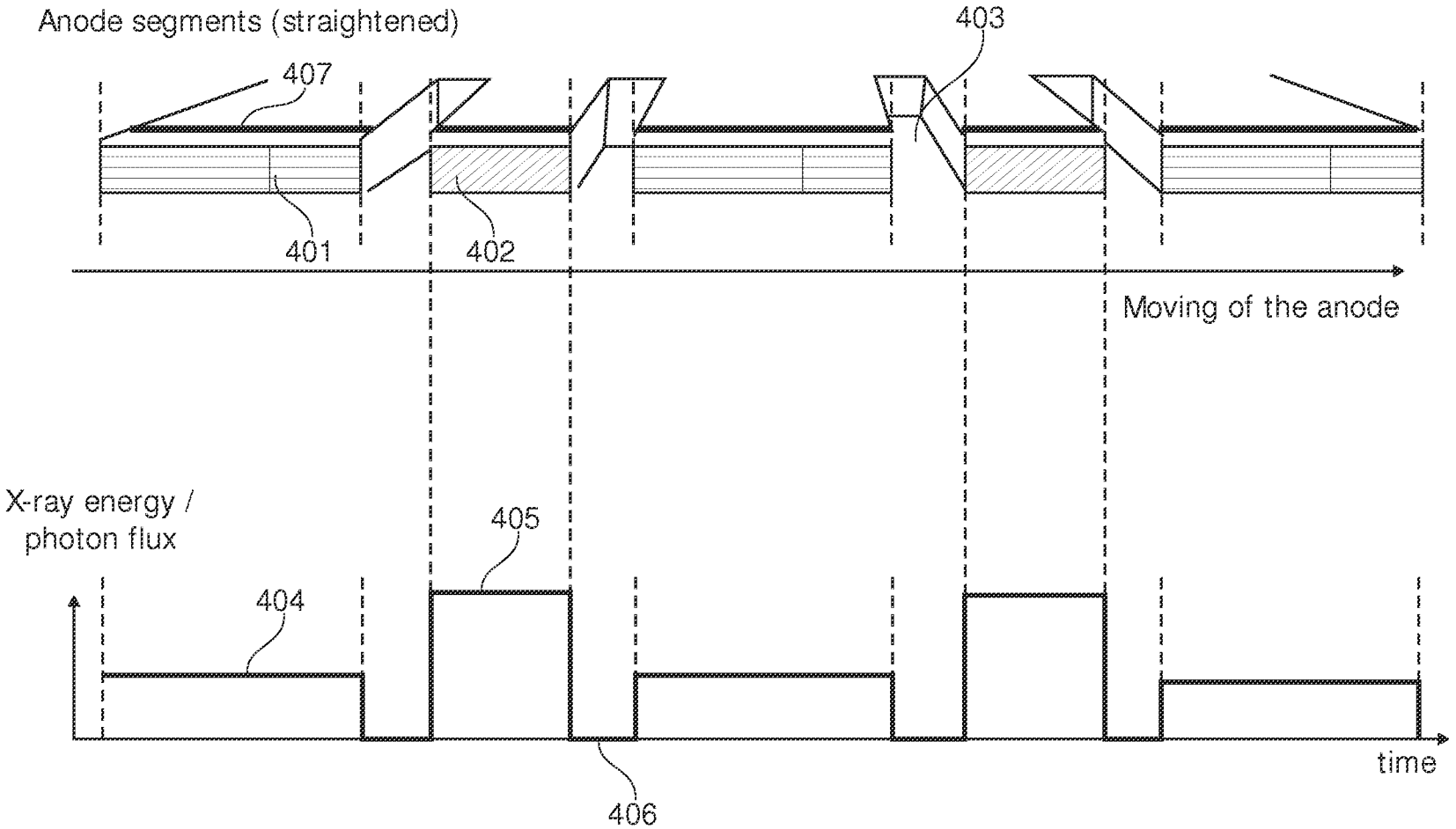
FIG. 4 depicts a part of an anode schematically.

FIG. 4 shows a schematic diagram of a part of an anode, wherein the anode is depicted in a straightened way. It is shown parts 401 of the anode with a low energy and parts of the anode with a high energy 402. These different parts 401, 402 are electrically separated by gaps 403. There is much more flux from high energy segments 402 than from low energy segments 401. In order to compensate this difference the segments 401 are bigger than the segments 402. Typically, the isolating gaps 403 are therefore cut to the expense of the width of the segments 402. It is depicted the X-ray energy/photon flux, wherein there is a low X-ray energy during a long period of time 404, a high X-ray energy during a small period of time 405 and there is no X-ray energy during transition of the electron beam 407 of the gap 406.

Figure 5:
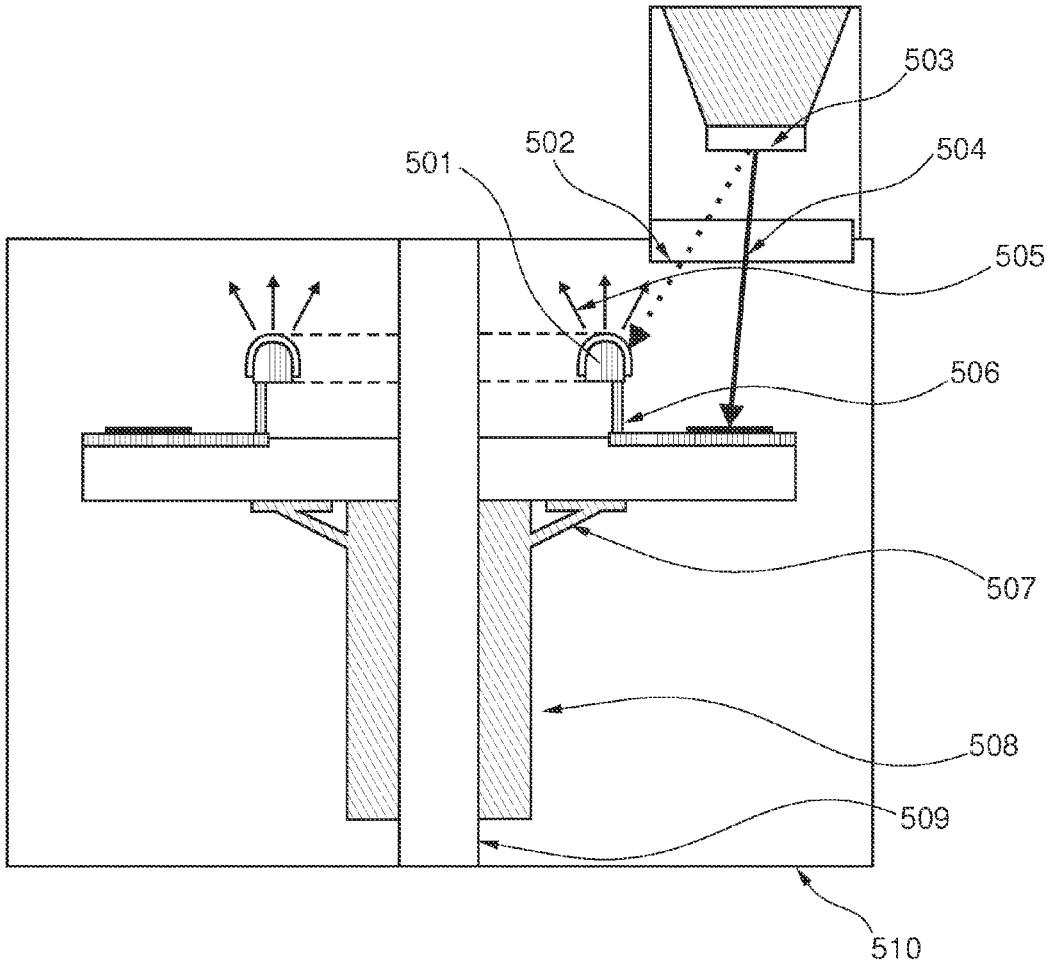
FIG. 5 depicts an X-ray tube schematically.

FIG. 5 shows an X-ray tube schematically according to the invention comprising an auxiliary cathode 501, which emits an auxiliary electron emission 505. A main cathode 503, which emits a primary electron beam 504, wherein this primary electron beam can be deflected 502. The auxiliary cathode 501 is hit by the deflected primary electron beam 502. Typically, the auxiliary cathode 501 is coated by a heat conducting ring, e.g. CfC, wherein the auxiliary cathode 501 is heated by the partly defected primary beam, wherein the amount of deflection controls the temperature and emission. It is shown contacts to low energy segments 506 and contacts to high energy segments 507, a bearing 508, a bearing axis 509 and the tube frame 510.

Figure 6:
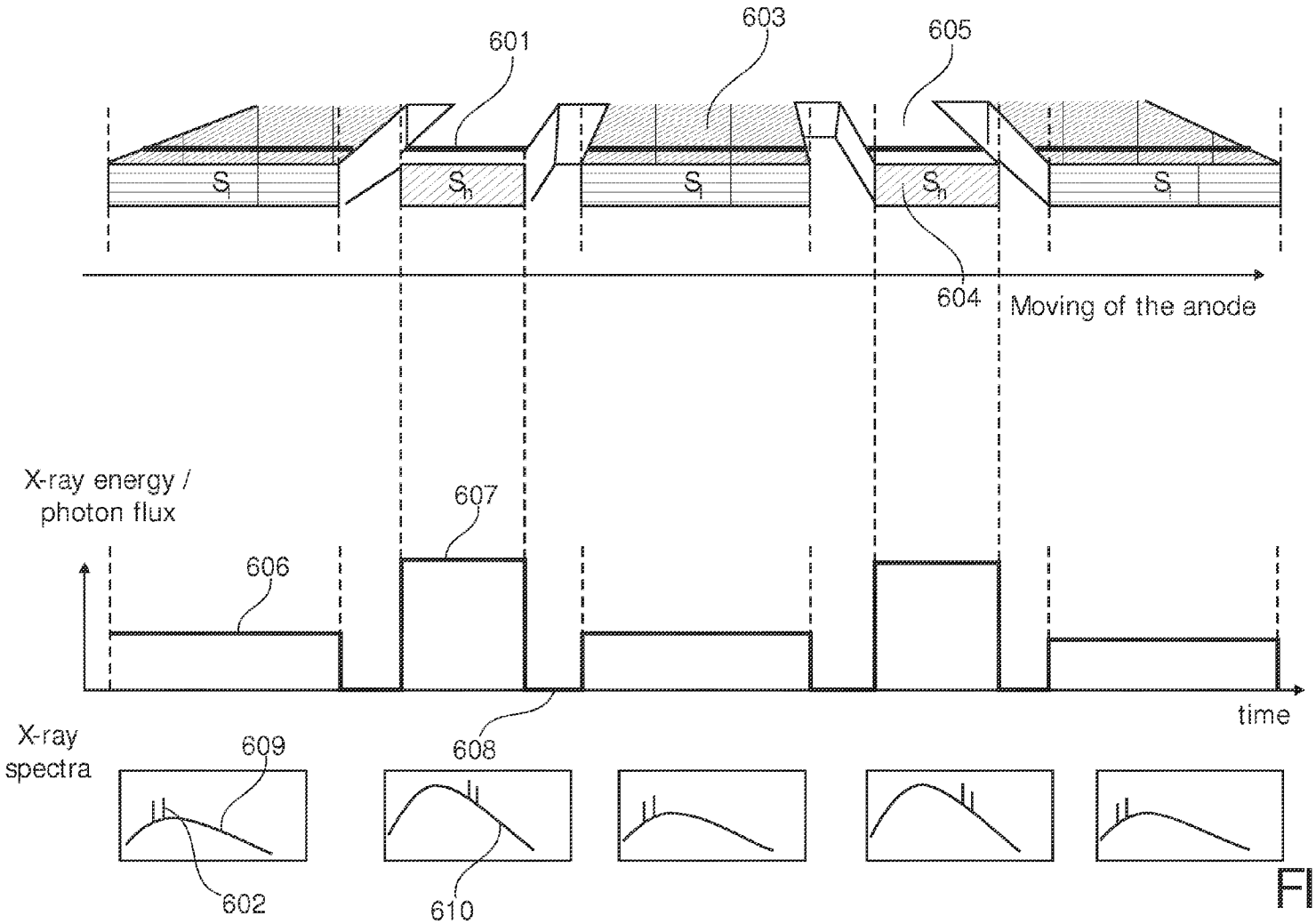
FIG. 6 depicts a part of an anode schematically.

FIG. 6 shows anode segments in a straightened way, wherein there are bigger segments 603, which have a small X-ray energy/photon flux and smaller segments 605, which have a high X-ray energy/photon flux. It is shown the different levels of X-ray energy along the anode segments in the straightened way, wherein the bigger segments have a lower X-ray energy 606 than the smaller segments 607 in order to equal the total energy emitted by the different segments. Between these areas 606, 607 there is the zero energy level 608 of the gap transition. Further, it is depicted the track of the electron beam 601 and a front side 604 of a segment. There are also diagrams of spectra 608, 609 with peaks 602, wherein the spectrum 609 belongs to a low X-ray energy segment 603 and the spectrum 610 belongs to a high X-ray energy segment 605.

Figure 7:
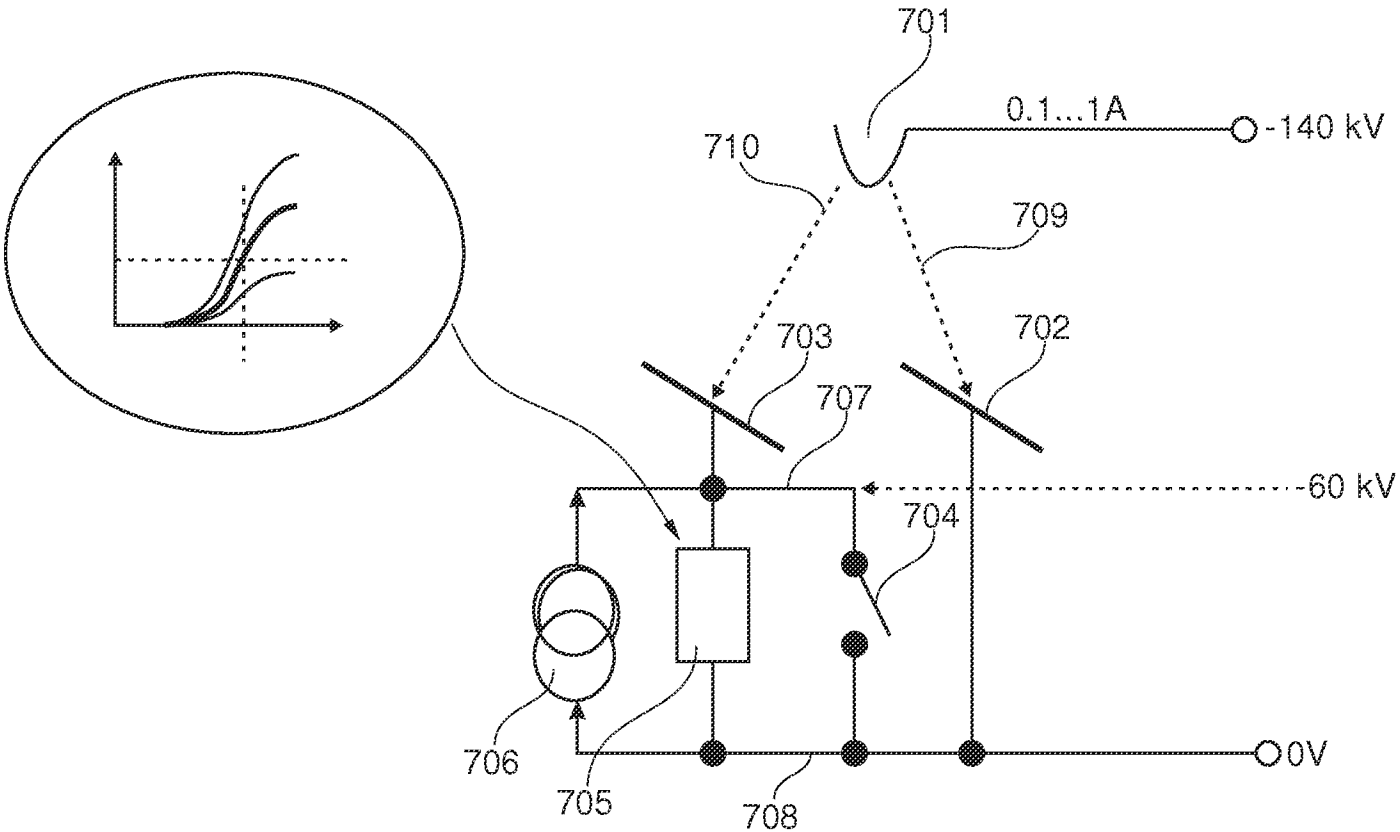
FIG. 7 shows an X-ray tube as an equivalent circuit diagram.

FIG. 7 shows an equal circuit diagram of an X-ray tube according to the invention. It is depicted a main cathode 701, wherein its electron beam 709 can be deflected 710 to one part of an anode 703. The main electron beam 709 is directed to another part of the anode 702. Further, the different parts of the anode 702, 703 have different values of electrical potential, wherein the electrical potential 707 of the part of anode 703 can be connected to the electrical potential 708 of the other part of the anode by a controllable (magnetic or thermal) switch 704. It is depicted the auxiliary electron emission system as a controllable resistor 705. Further, it is depicted the temperature dependent anode insulator leakage current and temperature dependent self-emission from the focal spot with the help of the symbol of a current source 706.

Figure 8:
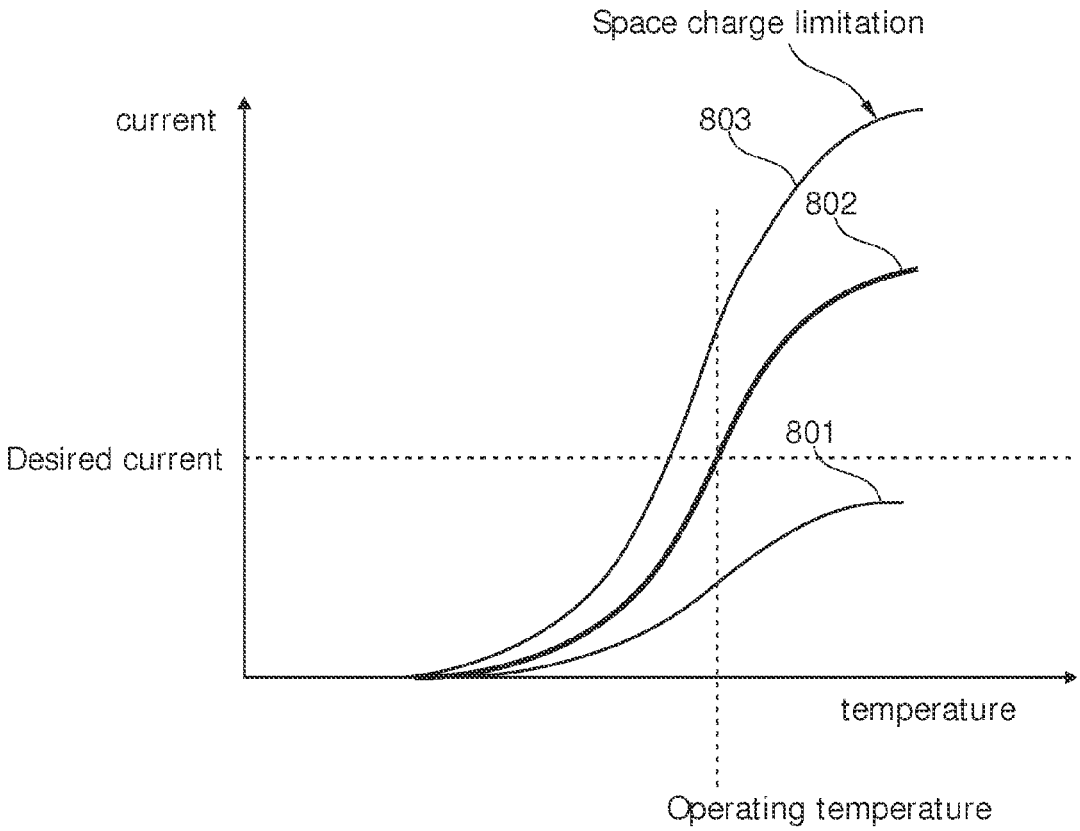
FIG. 8 shows the emission characteristics of an auxiliary cathode.

FIG. 8 shows the auxiliary electron emission system depicted as a controllable resistor, wherein it is depicted a high voltage level 803, a desired voltage level 802 and a low voltage level 801 of current along an increasing temperature.

Figure 9:
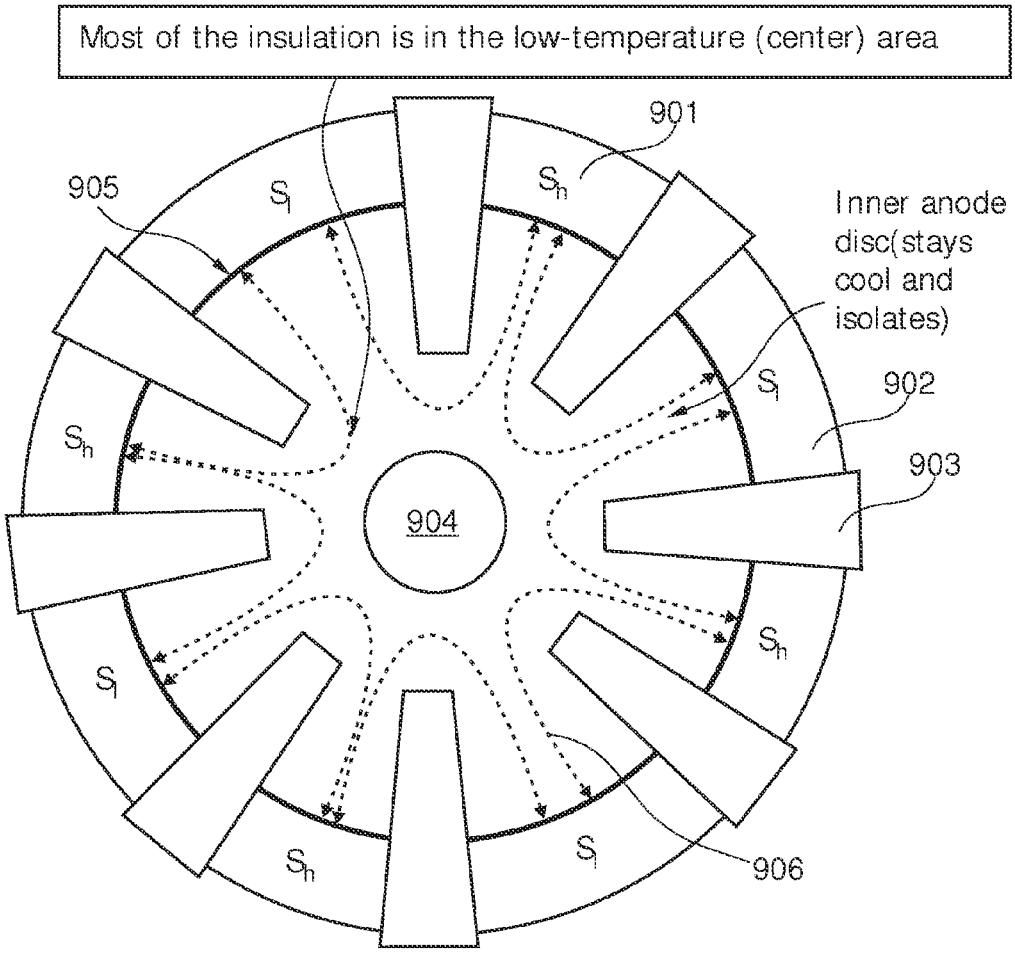
FIG. 9 shows an anode schematically.

FIG. 9 shows an anode according to the inventive concept, wherein the anode is divided into high energy segments 901 and low energy segments 902, which are arranged along an outer circular ring of the anode. The different segments 901, 902 have different electrical potentials and therefore, they have to be separated electrically by isolating elements. The different segments 901, 902 are separated by isolating areas 903. It is shown the focal track (hot) of the electron beam 905, which is shot on the different segments 901, 902. Further, it is depicted the heat sink 904, which is typically a spiral groove bearing and the streamlines of the field 906 of the heat.

Figure 10:
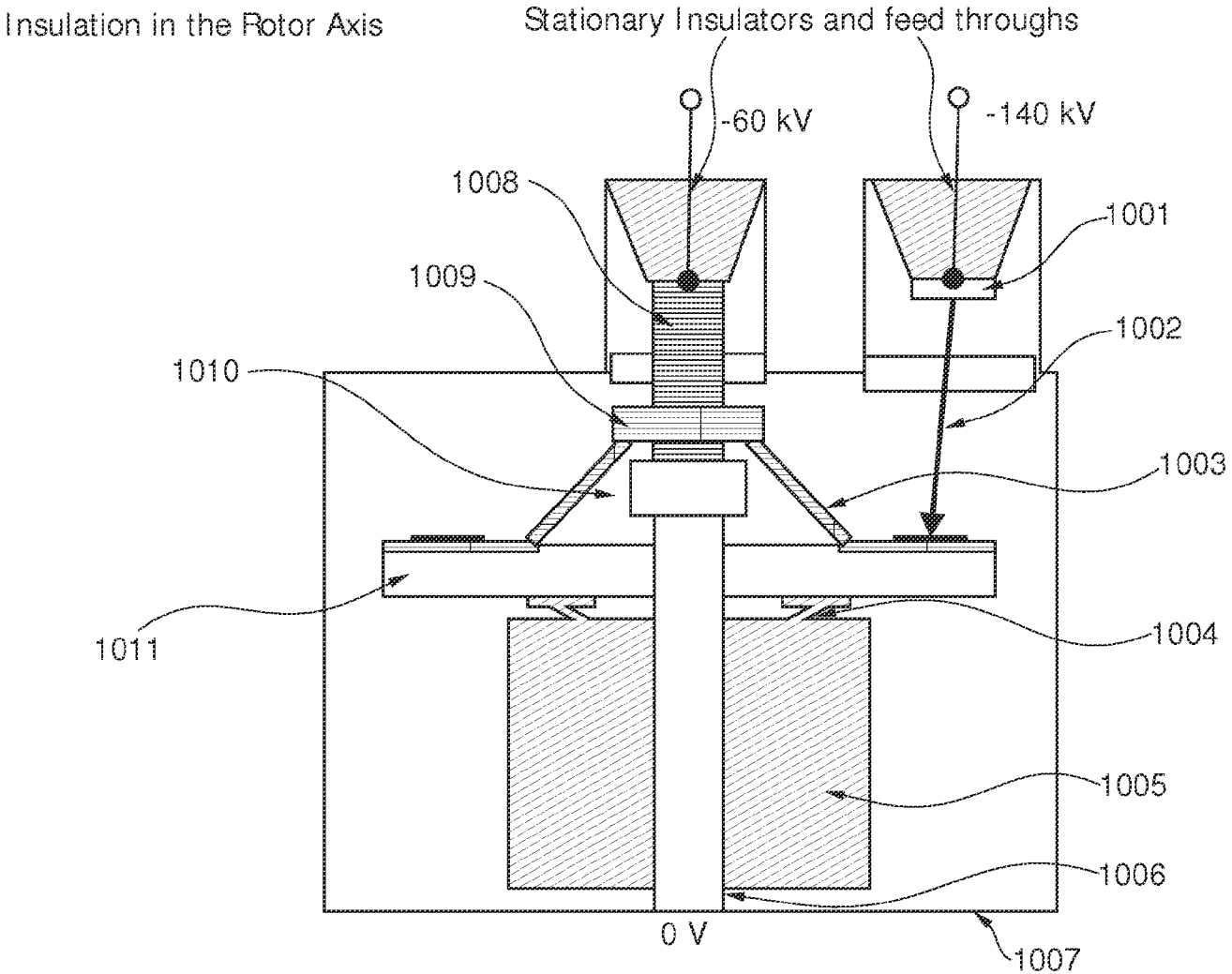
FIG. 10 shows a dual generator embodiment.

FIG. 10 shows an X-ray tube comprising a cathode 1001 for generating a primary electron beam 1002. Further, it is depicted contacts to focal tracks of low energy segments 1003 and contacts to focal tracks of high energy segments 1004. Furthermore, it is shown a first bearing axis 1008, a first bearing 1009, which provides a current contact, a second bearing 1005 and a second bearing axis 1006. Further, it is depicted a stationary insulator 1010 for separating the two parts of the axis and a rotating insulator 1011, which is e.g. an anode disc. Further, it is depicted the tube frame 1007.

Figure 11:
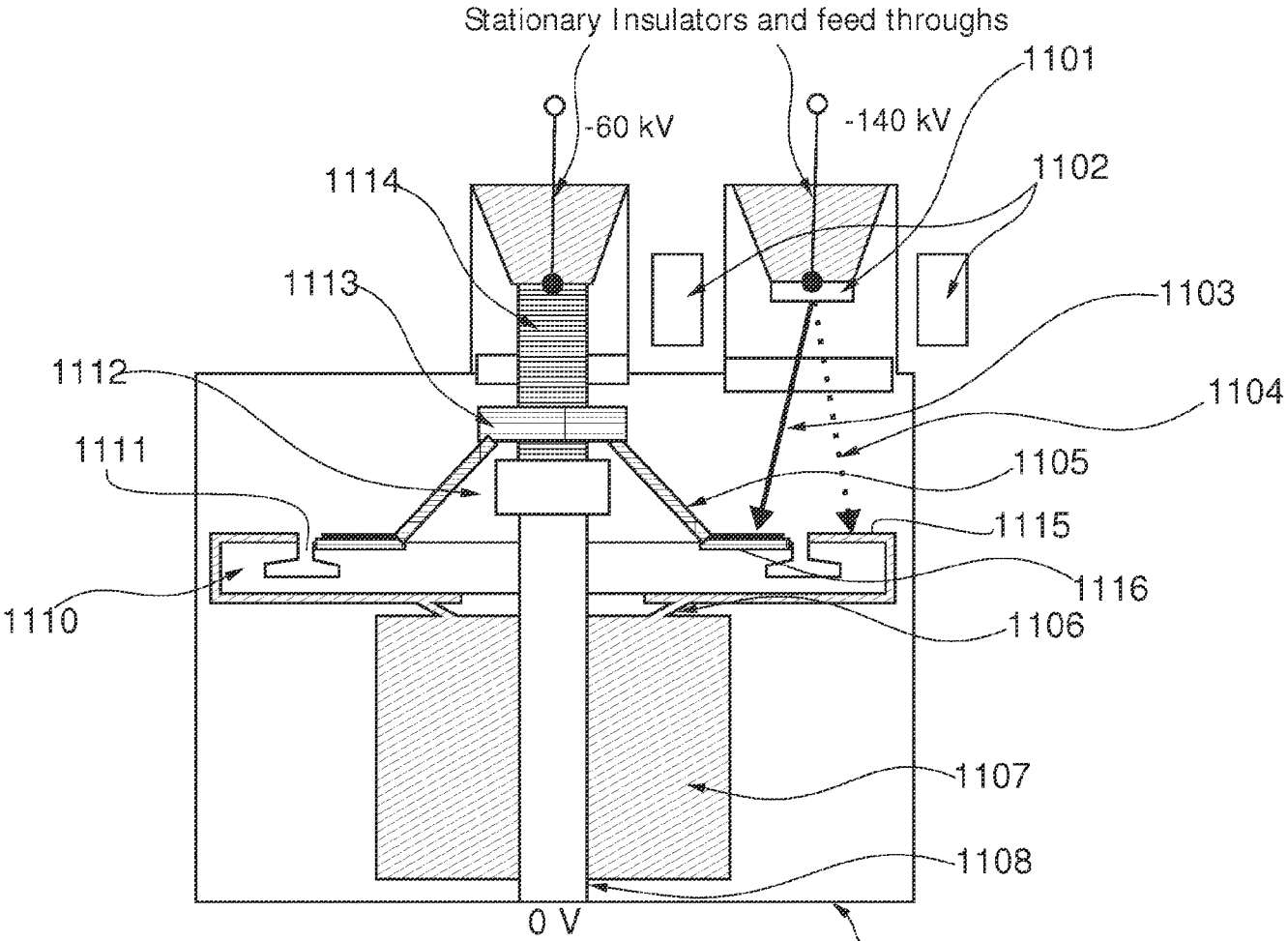
FIG. 11 shows an embodiment of concentric focal spot tracks.

FIG. 11 shows an X-ray tube comprising a cathode 1101 and means for radial deflection 1102. These means for radial deflection 1102 provide the possibility to deflect the electron beam 1103 in such way that instead of heating a first unit of an anode 1116 a second unit of the anode 1115 will be heated. It is also depicted a contact to low X-ray energy generating track 1105, a contact to high X-ray energy generating track 1106, a first bearing axis 1114, a first bearing 1113 for a current contact, a second bearing 1107 and a second bearing axis 1108. Further, it is depicted a stationary insulator 1112 separating the two parts of the axis, the rotating insulator 1110, which is e.g. an anode disc, and an insulation gap 1111, wherein the gap is a narrow current path underneath in cool area. The X-ray beam energy is switched by a fast radial deflection of the electron beam. The beam either hits the low potential track or the high potential track. Further, it is depicted the tube frame 1109.

Figure 12:
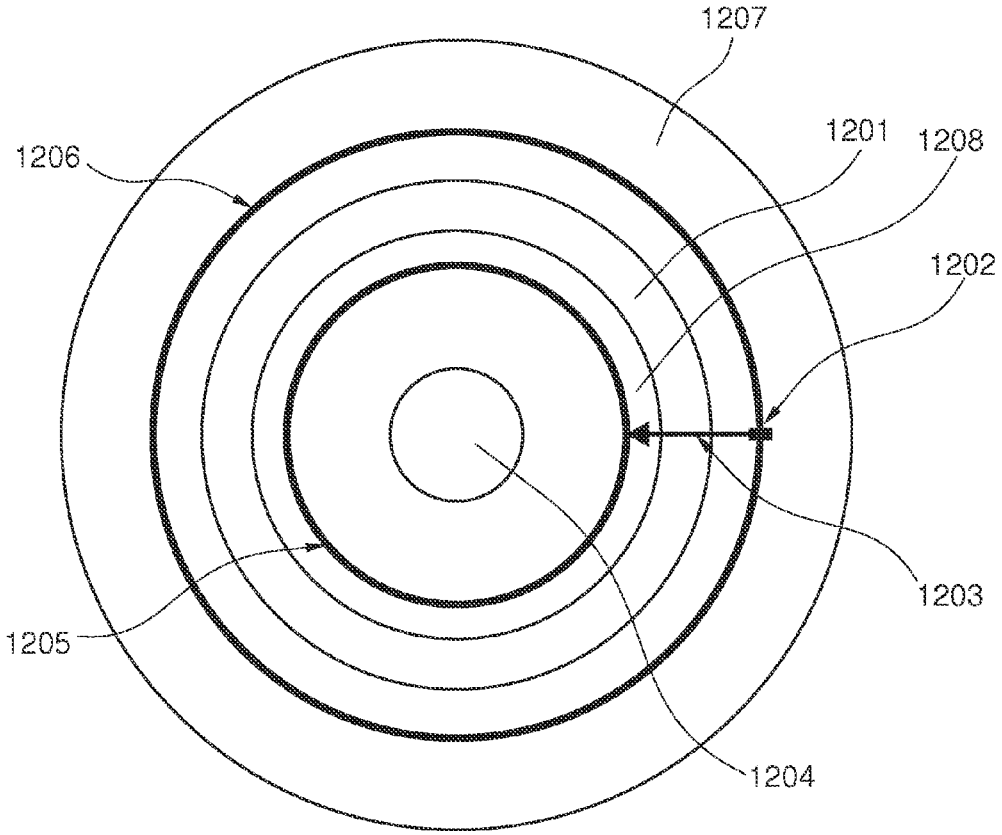
FIG. 12 shows an embodiment of focal spot tracks.

FIG. 12 shows an anode according to the invention, wherein it is depicted several circular rings, wherein an outer circular ring 1207 will be hit by a first electron beam along a first track 1206, wherein the first track is a high X-ray energy generating track. The electron beam can be deflected e.g. along a line 1203 in order to hit an inner circular ring 1208, wherein the inner circular ring 1208 will be hit along a circle 1205, which is a low X-ray energy generating track. Further, it is shown a heat sink 1204, e.g. a spiral groove bearing. The outer circular ring 1207 and the inner circular ring 1208 are separated by an isolating circular ring 1201 (isolating gap). Further, it is depicted the track 1203 of deflection back and forth and the focal spot 1202.

Figure 13:
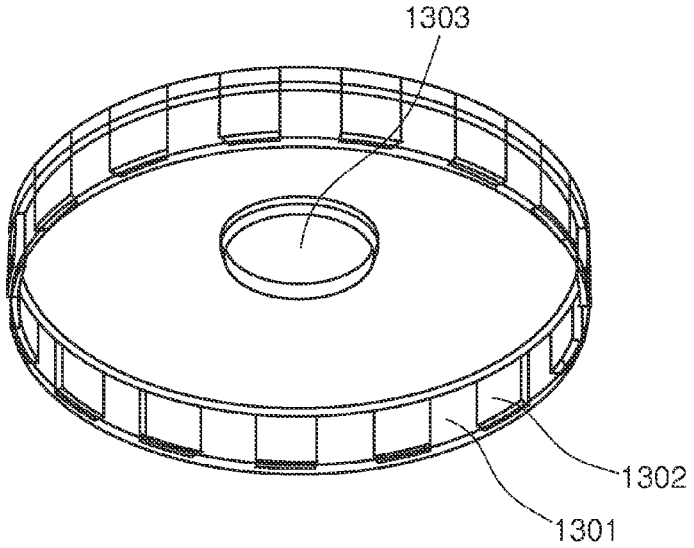
FIG. 13 shows an anode schematically.

FIG. 13 shows an anode according to the invention, wherein it is depicted a heat sink 1303, parts of the anode 1301 as well as isolating gaps 1302.

Figure 14:
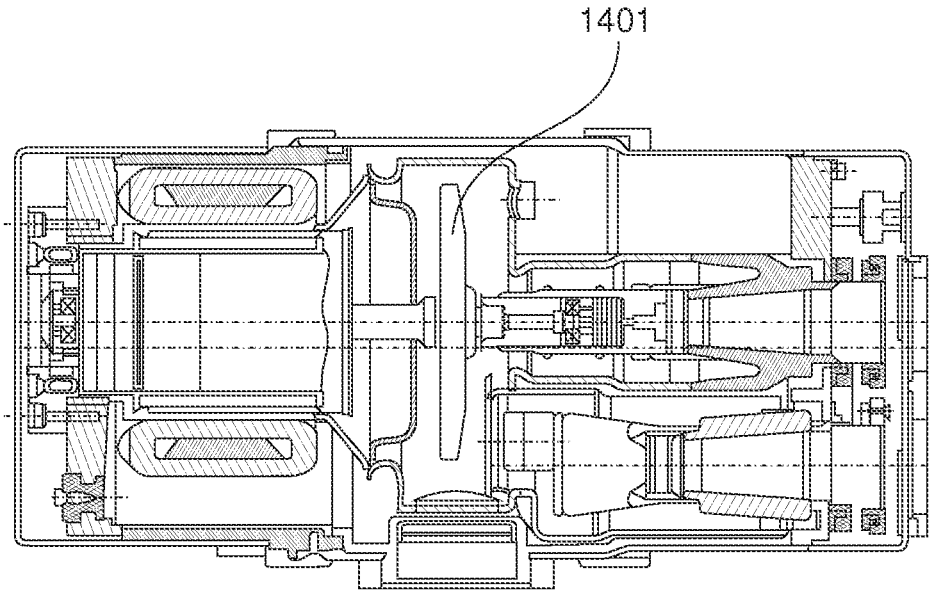
FIG. 14 depicts an X-ray tube schematically.

FIG. 14 shows an X-ray tube according to the inventive concept, wherein it is depicted an anode 1401.

Figure 15:
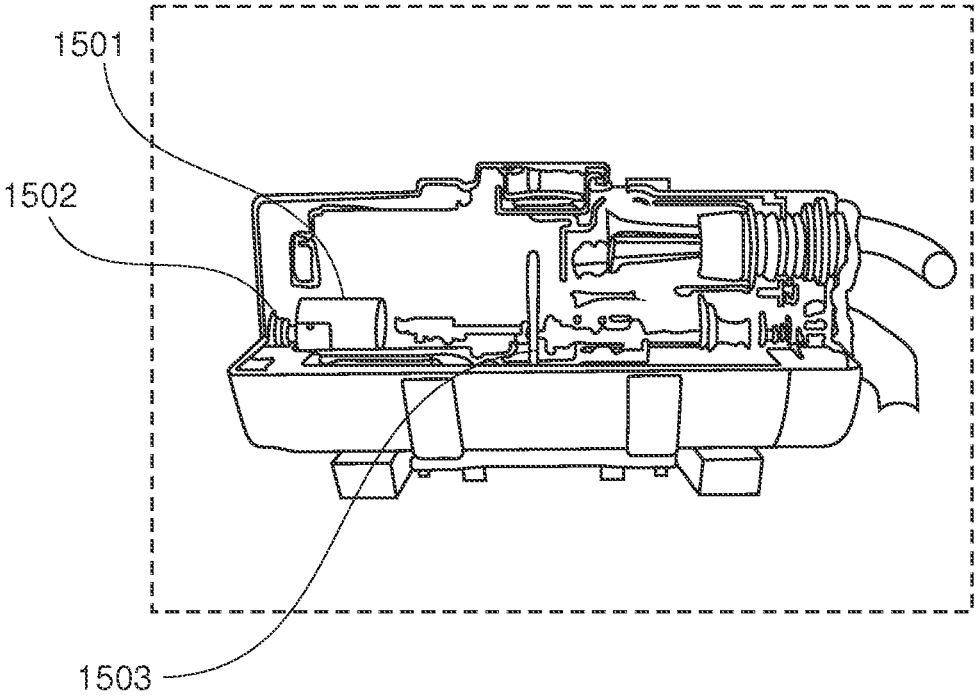
FIG. 15 shows an X-ray tube.

FIG. 15 shows an X-ray tube according to the inventive concept, wherein it is depicted a rotating insulator, a grounded end 1502 and a stationary insulator 1503 (+end).

The advantages of the inventive concept are the fact that there is no need for external high voltage switching. Therefore, the inventive concept provides the possibility for relatively short pulses and transition periods. Further, there are well defined X-ray energy levels and multiple energy levels possible.

According to the invention there is e.g. an anode track speed of 100 m/s (180 Hz, 200 mm), track length (pulse length) low energy: 20 mm (200 μs) possible. Typically, there are parts of the segment with electrical potentials of 60 kV, 40 kV. The isolating gap can be in the range of 4 mm to 6 mm, the track length/pulse length can be in the range of 8 mm to 12 mm (80 μs/120 μs). The transition time can be in the range of 40 μs to 60 μs.

It should be noted that the term 'comprising' does not exclude other elements or steps and the 'a' or 'an' does not exclude a plurality. Also elements described in association with the different embodiments may be combined.

It should be noted that the reference signs in the claims shall not be construed as limiting the scope of the claims.

LIST OF REFERENCE SIGNS

101 patient,
102 detector system,
103 tube,

104 fan beam of X-rays,
201 anode,
301 focal spot,
302 isolating slit,
303 focal track,
304 center,
305 focal track,
401 part of anode,
402 part,
403 gap,
404 period of time,
405 period of time,
406 gap,
407 electron beam,
501 auxiliary cathode,
502 electron beam,
503 main cathode,
504 electron beam,
505 auxiliary electron emission,
506 segment,
507 segment,
508 bearing,
509 bearing axis,
510 tube frame,
601 track of electron beam,
602 peaks of spectrum,
603 segment,
604 part of a segment,
605 segment,
606 energy level,
607 energy level,
608 energy level,
609 spectrum,
610 spectrum,
701 main cathode,
702 anode,
703 part of anode,
704 switch,
705 controllable resistor,
706 current source,
707 electrical potential,
708 electrical potential,
709 electron beam,
710 electron beam,
801 low voltage level,
802 desired voltage level,
803 high voltage level,
901 segment,
902 segment,
903 isolating area,
904 heat sink,
905 electron beam,
906 streamlines of field,
1001 cathode,
1002 electron beam,
1003 segment,
1004 segment,
1005 bearing,
1006 bearing axis,
1007 tube frame,
1008 bearing axis,
1009 bearing,
1010 insulator,
1011 insulator,
1101 cathode,
1102 means for deflection,
1103 electron beam,
1104 electron beam,
1105 contact,
1106 contact,
1107 bearing,
1108 bearing axis,
1109 tube frame,
1110 insulator,
1111 gap,
1112 insulator,
1113 bearing,
1114 bearing axis,
1115 anode,
1201 circular ring,
1202 focal spot,
1203 track of focal spot,
1204 heat sink,
1205 circle,
1206 track,
1207 circular ring,
1208 circular ring,
1301 anode,
1302 gap,
1303 heat sink,
1401 anode,
1501 insulator,
1502 grounded end,

The invention claimed is:

1. A rotatable anode for an X-ray tube, comprising:

a first unit adapted for being hit by a first electron beam; and at least a second unit adapted for being hit by at least a second electron beam, wherein the first unit and the at least second unit are electrically isolated from each other, wherein the anode is adapted to interact with an auxiliary cathode, wherein the auxiliary cathode is adapted to influence an electrical potential, wherein the auxiliary cathode is adapted for being heated by the second electron beam, wherein the auxiliary cathode is adapted to interact with a main cathode, and wherein the second electron beam is generated by the main cathode by deflection of the first electron beam.

2. The anode according to claim 1, wherein the first unit comprises a first part of a circular ring of the anode, and wherein the at least second unit comprises at least a second part of the circular ring of the anode.

3. The anode according to claim 1, wherein the first unit comprises a first circular ring and the at least second unit comprises at least a second circular ring, wherein the first circular ring and the at least second circular ring are separated by at least a further circular ring, wherein the further circular ring is non-conductive.

4. The anode according to claim 1, wherein the anode is adapted in such a way, that the first unit has a first electrical potential and the at least second unit has at least a second electrical potential, wherein the first electrical potential and the at least second electrical potential are different.

5. The anode according to claim 1, wherein the first unit has a first surface for being hit by the first electron beam, the at least second unit has at least a second surface for being hit by the second electron beam, wherein the first surface is smaller than the at least second surface.

6. The anode according to claim 5, wherein the first unit has a first electrical potential, wherein the at least second unit has at least a second electrical potential, and wherein an absolute value of the first electrical potential is higher than an absolute value of the at least second electrical potential.

7. A main cathode, wherein the main cathode is adapted to interact with the anode according to claim 1, wherein the main cathode is adapted to generate the first electron beam and the second electron beam, and wherein the main cathode comprises means for deflecting the first electron beam for generating the second electron beam.

8. Device for determining an electrical potential by detecting a point of impact of an electron beam onto the anode according to claim 1 and/or by detecting an X-ray spectrum of radiation starting from the anode, wherein the electron beam comprises one of (i) the first electron beam, (ii) the second electron beam, and (iii) the first and second electron beams and is generated by a cathode, wherein the electron beam hits the first unit of the anode at a first point of impact, wherein the electron beam is deflected and the deflected electron beam hits the second unit of the anode at a second point of impact, and wherein one of (i) the first unit, (ii) the second unit and (iii) the first unit and the second unit emit the radiation.

9. Device for adjusting a heating of the auxiliary cathode according to claim 1, wherein the device is adapted to control the heating of the auxiliary cathode.

10. An X-ray system, comprising:

an anode, wherein the anode comprises a rotatable anode for an X-ray tube that includes a first unit adapted for being hit by a first electron beam, and at least a second unit adapted for being hit by at least a second electron beam, wherein the first unit and the second unit are electrically isolated from each other;

a main cathode for generating an electron beam, wherein the main cathode is adapted to generate a first electrical potential; and an auxiliary cathode for influencing a second electrical potential, wherein the main cathode is adapted to deflect the electron beam in order to heat the auxiliary cathode.

11. The X-ray system according to claim 10, wherein the main cathode is adapted to deflect the electron beam during a transition of a gap of the electron beam, wherein the gap is arranged between the first unit and the at least second unit of the anode.

12. The X-ray system according to claim 10, wherein the first unit is connected to a potential supplied by an external source, and wherein the at least second unit is connected to the auxiliary cathode.

13. Device for switching electrical potentials, wherein the device is adapted to connect or isolate the first electrical potential and the second electrical potential of the X-ray system according to claim 10.

14. Device for deflecting the electron beam of the X-ray system according to claim 10, wherein the device is adapted to direct the electron beam to the first unit of the anode.

* * * * *